United States Patent [19]

Stahlecker

[11] 3,942,311

[45] Mar. 9, 1976

[54] METHOD AND APPARATUS FOR START-SPINNING A THREAD ON AN OPEN-END SPINNING MACHINE

[75] Inventor: Fritz Stahlecker, Bad Uberkingen, Germany

[73] Assignees: Fritz Stahlecker; Hans Stahlecker, both of Germany

[22] Filed: July 11, 1974

[21] Appl. No.: 487,660

[30] Foreign Application Priority Data

July 21, 1973 Germany ..... 2337246

[52] U.S. Cl. ..... 57/34 R; 57/58.89; 57/156

[51] Int. Cl.[2] ..... D01H 15/00

[58] Field of Search ..... 57/34 R, 58.89–58.95, 57/156, 22

[56] References Cited

UNITED STATES PATENTS

| | | | |
|---|---|---|---|
| 3,354,631 | 11/1967 | Elias et al. | 57/58.95 |
| 3,501,905 | 3/1970 | Landwehrkamp et al. | 57/58.89 |
| 3,523,300 | 8/1970 | Tabata et al. | 57/58.91 |
| 3,540,201 | 11/1970 | Susami et al. | 57/58.95 X |
| 3,543,500 | 12/1970 | Bancroft et al. | 57/58.89 |
| 3,601,969 | 8/1971 | Susami et al. | 57/58.91 |
| 3,695,017 | 10/1972 | Hori et al. | 57/58.95 X |

*Primary Examiner*—Donald E. Watkins
*Attorney, Agent, or Firm*—Craig & Antonelli

[57] ABSTRACT

To start-spin a thread with open-end spinning, the end of the thread is inserted back into the spinning rotor against the normal direction of draw and placed on a ring of separated fibres. In order to simplify placing the thread on the ring and to improve the strength of the start-spinning point in the thread, before being placed on the ring of fibres, the returned end is freed of the twist in the thread produced during spinning, causing this end to be in a condition which corresponds generally to the condition of the ring of separated fibres.

4 Claims, 2 Drawing Figures

METHOD AND APPARATUS FOR START-SPINNING A THREAD ON AN OPEN-END SPINNING MACHINE

Figure 1:
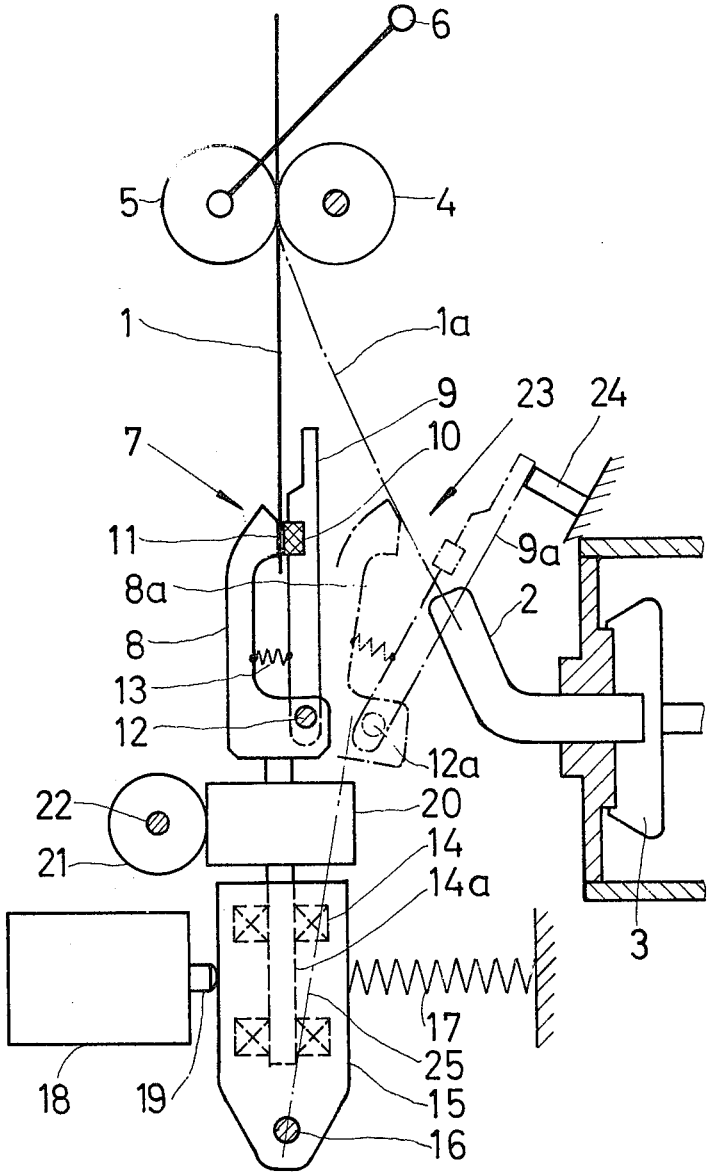

The present invention relates to a method and an apparatus for start-spinning a thread on an openend spinning machine, in which a ring of separated fibres is deposited in a spinning rotor, with which an end of the thread which is reinserted into said spinning rotor against the direction in which it is drawn off is connected.

On an open-end spinning machine, start spinning is necessary when the machine is started or to remedy a thread break. To accomplish this, the end of the thread is reinserted into the spinning rotor, whereby special aids ensure that a given length of the end of the thread is inserted with a given speed at a given moment in order to provide proper start-spinning. While the known apparatuses herefor do permit start-spinning, the yarn is generally of lower quality at the start-spinning point, as the strength of the yarn must usually be reduced there and the yarn is often thicker there. To fabricate quality yarns, it has hitherto been necessary to clean the yarn fabricated on an open-end spinning machine during an additional rewinding operation, i.e. to trim out yarn defects and knot the ends of the thread.

In order to reduce the effort required herefor somewhat, it is known practice (German Laid Open Patent application No. 2,133,135) to avoid an additional rewinding operation by again separating and re-knotting the start-spun thread with a fully automatic apparatus on the open-end spinning machine. However the effort required herefor is still very considerable.

It is the object of the present invention to improve the start-spinning operation in such a manner as to avoid excessive thickness or excessively reduced strength in the yarn in the area of the start-spinning points, permitting additional yarn cleaning measures to be eliminated. According to the present invention, the spinning twist in the end of the thread is at least partially eliminated prior to or during reinsertion in the spinning rotor. By eliminating the previous spinning twist in the end of the thread, this end is placed in a condition which generally approximates the condition of the fibres deposited in the spinning rotor, permitting the yarn connection at the start-spinning point to be made more simply and more thoroughly, without being thicker and with almost no loss in strength.

In a further development of the invention, the spinning twist of the end of the thread is at least partially eliminated by twisting the thread in the opposite direction. While it is possible to eliminate the spinning twist by splicing, uncombing or air turbulence, etc., untwisting is especially advantageous.

In a further development of the invention, the end of the thread is drawn apart longitudinally after or during elimination of its spinning twist and prior to being reinserted into the spinning rotor. Drawing the thread apart further opens the end, in which the partial fibres are additionally loosened and made parallel, thus making them easier to start spin. In addition, no fibres are torn out, as is the case with the known start-spinning methods.

In order to maintain uniform conditions for start spinning, in a further development of the invention at least two means are provided for clamping the end of the thread, of which at least the outer means can be caused to rotate about the longitudinal axis of the thread. The amount of rotation can be monitored by counting the revolutions of the clamping means, for example. It is possible to provide for the end of the thread to be released and inserted into the spinning rotor automatically after a given number of revolutions.

In order to also permit the end of the thread to be drawn apart, in a further development of the invention at least one means for clamping the end of the thread is attached to drive means which are movable in the longitudinal direction of the thread. These drive means can also be actuated by means of a counter connected with the rotating means, for example.

Figure 2:
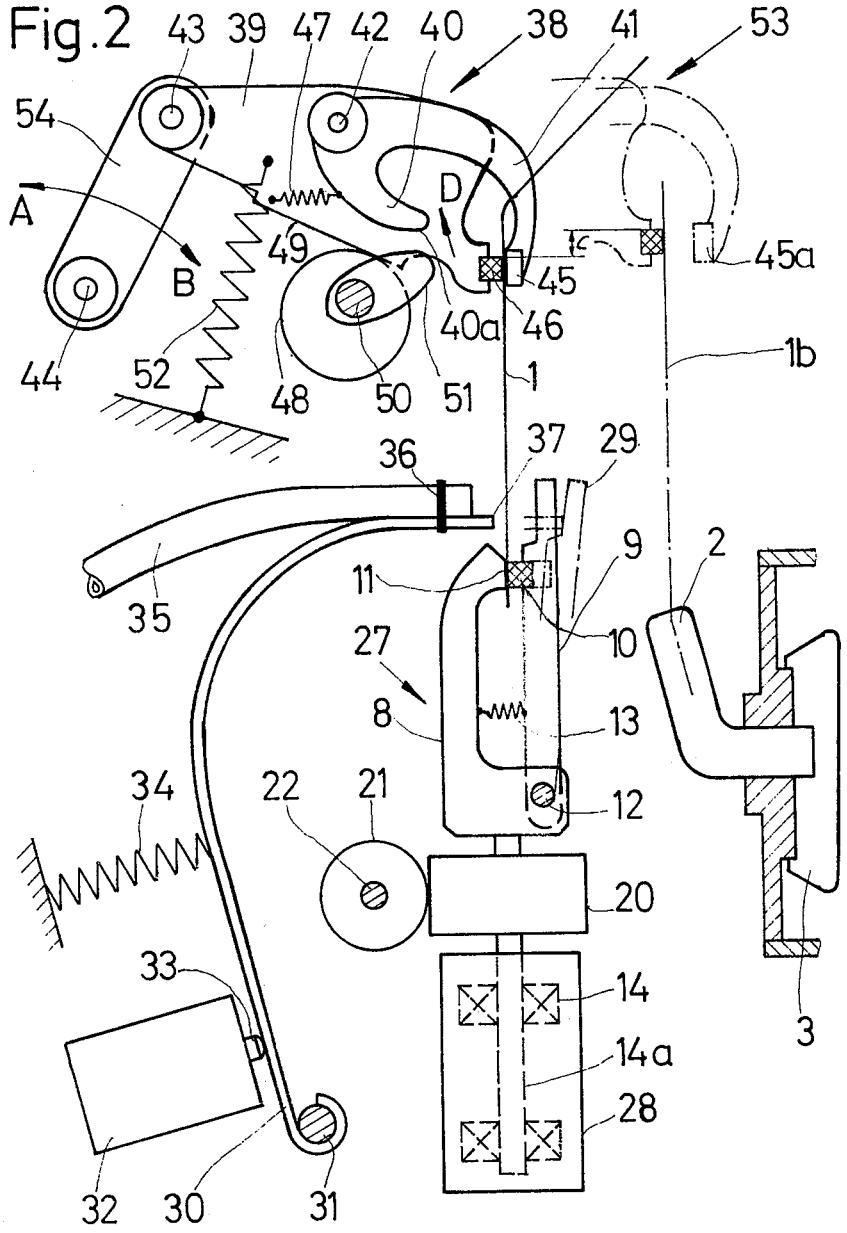

The above discussed and other objects, features and advantages of the present invention will become more apparent from the following description thereof, when taken in connection with the accompanying drawings, in which FIG. 1 shows a simple apparatus for performing the method according to the invention, and FIG. 2 shows an additional apparatus with which an additional step of the method can be performed.

Referring now to the drawings, wherein like reference numerals designate like parts throughout the several views, FIG. 1 shows only a yarn removal channel 2, a spinning rotor 3 and delivery rollers 4 and 5 of an open-end spinning machine, with which a thread 1 is drawn off to an unillustrated winding apparatus. Delivery roller 4 can preferably be driven in both senses of rotation, while delivery roller 5 is designed as a pressure roller which can swivel about axle 6. Delivery rollers 4 and 5 belong to an unillustrated start-spinning apparatus, with which a given length of thread 1 can be returned to spinning rotor 3 through yarn removal channel 2 when a start-spinning operation is to be performed. The end of thread 1 is then connected with a ring of fibres which is deposited continually in spinning rotor 3. In doing this, certain conditions must be maintained if the ring of fibres is to have given dimensions. This means that the return of the end of the thread to the spinning rotor must be matched to the unillustrated means for feeding and separating the fibres.

In order to permit neat start-spinning of the end of the thread with the ring of fibres deposited in the spinning rotor, the end of the thread is opened in such a manner that the spinning twist produced in it during spinning is eliminated. This is accomplished by opening the end of thread 1 between two clamping means. In the embodiment according to FIG. 1, one clamping means is the pair of delivery rollers 4 and 5, while the other clamping means is a rotary clamp 7.

Rotary clamp 7 contains two clamping levers 8 and 9, which are connected one with the other in a rotary manner about an axle 12. Clamping lever 9 has a clamping member 10, which is preferably resiliently yielding, to which a clamping surface 11 is associated on clamping lever 8. Clamping levers 8 and 9 are mounted by means of a shaft 14*a*in bearings 14, which are located in a housing 15, which is mounted pivotally about an axle 16. Housing 15, and thus rotary clamp 7, is held in the illustrated position, in which housing 15 is in a contacting relationship with the positioning member 19 of a solenoid switch 18, by a spring 17. In this position, a gear 20, for example a helical gear, arranged on shaft 14*a* meshes with a gear 21, also a helical gear for example, associated thereto and arranged on a drive shaft 22.

To start the machine, or to permit start-spinning in the event of a thread break, thread 1 is inserted in rotary clamp 7, if necessary after being trimmed to a given length, manually or automatically. The rotary drive for rotary clamp 7 is then switched on temporarily. Thread 1 is now opened by being rotated against its spinning twist in the area between the stationary pair of delivery rollers 4 and 5 and rotary clamp 7, as well as in the area located below rotary clamp 7. The amount the thread opened is controlled by unillustrated control means, whereby, for example, it is possible to count the number of revolutions of shaft 14*a*. The control means then switch off the rotary drive after thread 1 has been opened sufficiently. Thereafter, the control means actuate solenoid switch 18, which swivels housing 15 and rotary clamp 7 in such a manner, by means of its positioning member 19, that they are located in the area of the opening of yarn removal channel 2. Clamping lever 8 is then located in the dash-dotted position 8*a*. Associated to clamping lever 9 in this position is a magnet 24, which can also be energized by means of the above mentioned control means and which then attracts clamping lever 9 in dash-dotted position 9*a* to it, causing thread 1*a* to extend from the mouth of yarn removal channel 2 as shown by the dashed line. It is then sucked into spinning rotor 3 with the aid of a vacuum. The course of the sucking-in operation of the opened end of the thread can be determined by controlling the drive of delivery rollers 4 and 5, for example. After start-spinning has been completed, delivery rollers 4 and 5 switch off, permitting the thread to be drawn off through yarn removal channel 2 and advanced to its winding bobbin in an unillustrated manner.

Starting and stopping of the fibre feed and opening means can be controlled in an unillustrated manner by a thread stop-motion arranged in the area of the outlet of yarn removal channel 2, which responds to the thread tension present. If there is an insufficient thread tension, it switches off the fibre feed and opening means and, if desired, the drive of spinning rotor 3 as well. The above are not switched on again until there is sufficient thread tension again after thread 1 has been returned.

The apparatus according to FIG. 2 operates with a rotary clamp 27 and with a second means for clamping the end of the thread, i.e., a thread trapper 38. Rotary clamp 27 consists primarily of two clamping levers 8 and 9, a rotatable shaft 14*a*, as well as a housing 28, in which bearings 14 for shaft 14*a* are located. Shaft 14*a*, and thus clamping levers 8 and 9, can be rotated temporarily by means of helical gears 20 and 21 and a drive shaft 22. Clamping lever 9 can be swivelled about an axle 12 of clamping lever 8 against the force of a tension spring 13. A clamping member 10 presses thread 1 against a surface 11 located on clamping lever 8.

Rotary clamp 27 is opened by means of a solenoid switch 32 responding to unillustrated control means, whereby the plunger 33 of solenoid switch 32 swivels a bent lever 30 about point 31 against the force of a tension spring 34. Surface 37 of bent lever 30 presses against clamping lever 9, placing it in the dash-dotted position 29. A flexible hose 35 can be attached to bent lever 30 by means of a clip 36 for exhausting any thread remains.

Thread trapper 38 is formed by a lever mechanism, comprised primarily of a temporarily driven swivel lever 54, a control lever 39, as well as a double lever consisting of the two lever arms 40 and 41. Swivel lever 54 can be swivelled about axle 44 in the direction of arrows A and B by means of drive means controlled in an unillustrated manner. Under the effect of a tension spring 52, a roller contact surface 49 of control lever 39 presses against an eccentric 48, driven temporarily by unillustrated means, which swivels about eccentric shaft 50. Rigidly connected with eccentric 48 is a cam 51, which comes into a contacting relationship with surface 40*a* of double lever 40, 41 when rotated in the direction of arrow D, rotating lever arm 40 against the force of a tension spring 47 about axle 42 arranged at control lever 39. The thread trapper 45, 46 can be opened by this rotary motion of double lever 40, 41. As a result of a swivel motion of swivel lever 54 in the direction of arrow B and simultaneous rotation of eccentric shaft 50 in the direction of arrow D, control lever 39 moves somewhat to the right and is simultaneously lifted distance c, thereby opening, actuated by cam 51, thread trapper 45, 46. The new position is indicated at 53 with dash-dotted lines.

The method of operation of this apparatus is as follows:

Thread 1 to be start-spun, inserted in rotary clamp 27 and thread trapper 38 by unillustrated means is opened enough to at least partially separate the existing spinning twist. During this operation or thereafter, thread trapper 38 is lifted upward the distance *c*, thereby pulling thread 1 apart somewhat. Opening thread trapper 38 in the dash-dotted position 53 and opening rotary clamp 27 places opened and drawn apart thread 1 in the dash-dotted position 1*b*, so that it is drawn into yarn removal channel 2, and thus into spinning rotor 3, as a result of the underpressure in the unillustrated spinning chamber. It is important for the end of thread 1, which is start-spun to the ring of fibres, to really be opened and untwisted. This is generally only the case when the free end extending beyond rotary clamp 7 or 27 is kept short. It is also possible to cut off thread 1 between the two clamping means and to then reinsert it in spinning rotor 3. This ensures that the trimmed, reinserted thread is untwisted and opened in the pre-determined manner at the cutting point.

Obviously, many modifications and variations of the present invention are possible in the light of the above teachings. It should therefore be understood that within the scope of the appended claims, the invention may be practiced otherwise than specifically described.

Having thus fully disclosed my invention, what I claim is:

1. A method for start-spinning a thread on an open-end spinning machine, in which a ring of separated fibres is deposited in a spinning rotor, with the end of said thread which is reinserted into said spinning rotor against the direction in which it is drawn, being connected with said ring of fibres, whereby the spinning twist produced in said thread through spinning is eliminated at said end of the thread by untwisting said thread in the opposite direction so that the end of said thread is reduced to fibre tuft prior to or during reinsertion into said spinning rotor.

2. The method according to claim 1, in which the end of said thread is drawn apart longitudinally prior to being reinserted in said spinning rotor.

3. An apparatus for start-spinning a thread on an open-end spinning machine, containing means for opening and inserting threads into a spinning rotor and containing means for reinserting the end of said thread into said spinning rotor against the direction of draw of said thread, said means containing at least two means for clamping the end of said thread, of which at least the outer means can be caused to rotate about the longitudinal axis of said thread to eliminate the spinning twist produced in said thread so that the end of said thread is reduced to fibre tuft.

4. The apparatus according to claim 3, in which at least one of said means for clamping the end of said thread is attached to drive means which are movable in the longitudinal direction of said thread.

* * * * *